United States Patent [19]

Frank

[11] 4,174,968

[45] Nov. 20, 1979

[54] PHOTOGRAPHIC REVERSAL PROCESS WITHOUT SECOND EXPOSURE

[75] Inventor: Karl Frank, Leverkusen, Fed. Rep. of Germany

[73] Assignee: Agfa-Gevaert Aktiengesellschaft, Leverkusen, Fed. Rep. of Germany

[21] Appl. No.: 865,527

[22] Filed: Dec. 29, 1977

[30] Foreign Application Priority Data

Jan. 5, 1977 [DE] Fed. Rep. of Germany ..... 2700290

[51] Int. Cl.[2] ..... G03C 7/00; G03C 5/50

[52] U.S. Cl. ..... 430/375; 430/407; 430/449

[58] Field of Search ..... 96/59, 22, 55

[56] References Cited

U.S. PATENT DOCUMENTS

| | | | |
|---|---|---|---|
| 2,339,309 | 1/1944 | Weber et al. | 96/59 |
| 3,168,400 | 2/1965 | Blackmer et al. | 96/59 |
| 3,246,987 | 4/1966 | Hanson et al. | 96/22 |
| 3,617,282 | 11/1971 | Bard et al. | 96/22 |
| 3,658,535 | 4/1972 | Willems | 96/59 |
| 3,776,730 | 12/1973 | Matejec et al. | 96/55 |
| 3,883,354 | 5/1975 | Molenda | 96/22 |
| 4,057,427 | 11/1977 | Enriquez | 96/55 |

*Primary Examiner*—J. Travis Brown

[57] ABSTRACT

A photographic reversal process is provided in which the photographic material is treated with a potential fogging agent in the preliminary bath preceding the color development bath in such a manner as to obviate the disadvantages of known chemical fogging agents.

9 Claims, No Drawings

PHOTOGRAPHIC REVERSAL PROCESS WITHOUT SECOND EXPOSURE

This invention relates to an improved reversal process for the production of positive photographic images.

In conventional photographic reversal processes for the production of positive coloured photographic images, the photographic material which has been exposed imagewise is first developed with a first developer. It is then exposed uniformly to light before it is subjected to a second development using a colour developer. The process is completed by fixing, bleaching and fixing or bleach fixing the photographic material.

This reversal process could be carried out much more simply and reliably if the second exposure could be replaced by some suitable treatment of the photographic material. The second exposure is particularly difficult to handle when processing roll films or small gauge films in spirals or flat films in flat holders designed for repeated use.

It is known that the step of uniform exposure can be avoided by using chemical fogging agents which are added, at the latest, at the second development stage. Fogging agents which have been described for this purpose include, for example, boranocarbonates, borohydrides, alkylaminoboranes and tin-(II) - chelates of polyaminopolycarboxylic acids. Examples of fogging agents may be found, for example, in German Offenlegungsschriften Nos. 1,814,834 and 1,622,258.

One disadvantage of these compounds is that they are reducing substances which are therefore sensitive to atmospheric oxygen when in solution so that the concentration of active substance in the solution (fogging bath) does not remain constant. This effect is particularly pronounced in the previously known fogging baths, in which the correct degree of fogging is obtained by having the active substance at a certain concentration within very narrow limits. If, for example, the active substance were provided in a concentration higher than the required concentration in order to compensate for the loss by atmospheric oxidation during the process, the active substance would not only give rise to the desired formation of nuclei but would also cause additional reduction of silver halide which would then not be available for the formation of dye in the colour developer. One is also limited in the choice of the strength of the reducing agent because, if the reducing substance is too strong and attempts are made to diminish its effect by using it at a lower concentration, the layers no longer respond to the reducing agent to the same extent.

It is an object of the present invention to provide photographic reversal processes which are arranged so that the uniform second exposure can be replaced by chemical fogging. It is a particular object of the invention to find chemical fogging agents and to use them in such a manner as to reduce or substantially to obviate the disadvantages of the known chemical fogging agents, particularly their inadequate stability.

It has now been found that the problems mentioned above can be solved if the photographic material which has undergone first development is treated with a potential fogging agent in a preliminary bath preceding the colour development bath. Potential fogging agents may be either metal ions in a low oxidation state or substances which contain no metals, e.g. hydriazine of hydroxylamine salts or salts of their derivatives or iminoaminomethane sulphinic acid compounds, e.g. thiourea dioxide.

The metal ions serving as potential reducing agents may be used either in the form of their salts or in the form of complexes. In the latter case, the complex former and the pH are chosen so that the reducing power of the metal ion is not enhanced in the given solution and, what is more important, that the metal ion is complexed in its higher valency state, too. For the process according to the invention, it is necessary that the metal ion of the higher valency state formed by fogging is converted into a complex by means of a complexing agent.

For the process according to the invention it is particularly suitable to use metal ions of low valency belonging to the transition elements, in particular $Ti^{+++}$, $Mn^{++}$, $Fe^{++}$, $Co^{++}$ and $Ce^{+++}$. The complexing agents according to the invention may be aquoligands or other substances, for example carboxylic acids. The metal ions may thus be used as aquo-complexes or they may be complex bound, for example with hydroxycarboxylic acids, e.g. lactic acid, polycarboxylic acids, e.g. oxalic acid, hydroxypolycarboxylic acids, e.g. citric acid, polyhydroxypolycarboxylic acids, e.g. tartaric acid, with aminoalkylcarboxylic acids, e.g. nitrilotriacetic acid, ethylene diaminotetracetic acid, diethylene triaminopentacetic acid, isopropanoldiamine-(1,3)-tetracetic acid or N-hydroxyethyl-N,N', N'-ethylene diaminotriacetic acid with phosphonic acids, e.g. hydroxylalkylidene polyphosphonic acids, such as 1-hydroxyethylidene-1,1-diphosphonic acid, or e.g. aminoalkyl-(poly)phosphonic acids, such as nitrilotrimethylene triphosphonic acid, or with phosphono carboxylic acids.

The metal complexes according to the invention may be prepared by simply adding the complexing agent and the metal ions together.

The sulphates and chlorides of hydrazine and of hydroxylamine and iminoaminomethanesulphinic acid compounds such as thiourea dioxide are also suitable for the process according to the invention.

Typical examples of methods of procedure for the process according to the invention are given in the examples but the invention is not restricted to them. The usual colour developer substances may be used, for example the following:

N,N-Dimethyl-p-phenylenediamine;
4-amino-3-methyl-N-ethyl-N-methoxyethylaniline;
2-amino-5-diethylaminotoluene;
N-butyl-N-ω-sulphobutyl-p-phenylenediamine; 2-amino-5-(N-ethyl-N-β-methanesulphonamidoethylamino)-toluene;
N-ethyl-N-β-hydroxyethyl-p-phenylenediamine;
N,N-bis-(β-hydroxyethyl)-p-phenylenediamine and
2-amino-5-(N-ethyl-N-β-hydroxyethylamino)-toluene;

Other suitable colour developers have been described, for example, in J. Amer. Chem. Soc. 73, 3100 (1951).

The process according to the invention is applicable to the treatment of a light-sensitive photographic material which contains couplers. These compounds may be conventional colour couplers, which are generally incorporated directly in the silver halide layers. For example, the red sensitive layer may contain a non-diffusible colour coupler for production of the cyan partial colour image, generally a coupler based on phenol or α-naphthol. The green sensitive layer would contain at least one non-diffusible colour coupler for production of the magenta partial colour image, conventional colour couplers based on 5-pyrazolone or indazolone normally being used for this purpose. Lastly, the blue sensitive layer unit may contain at least one non-diffusible colour coupler for producing the yellow partial colour image, generally a colour coupler having an open chain ketomethylene group. Colour couplers of these kinds are known in large numbers and have been described in numerous Patent Specifications, for example in the publication entitled "Farbkuppler" by W. Pelz in "Mitteilungen aus den Forschungslaboratorien der Agfa, Leverkusen/München", Volume III (1961) and K. Venkataraman in "The Chemistry of Synthetic Dyes, " Vol. 4, 341–387 Academic Press 1971.

The non-diffusible colour couplers used may be 2-equivalent couplers which contain a releasable substituent in the coupling position so that they only require two equivalents of silver halide to form the dye, in contrast to the usual 4-equivalent couplers. Suitable 2-equivalent couplers include, for example, the known DIR couplers, in which the releasable group is released as a diffusible development inhibitor after the reaction with colour developer oxidation products. So-called white couplers may also be used in order to improve the properties of the photographic material.

The non-diffusible colour couplers and colour producing compounds are added to the light-sensitive silver halide emulsions or other casting solutions by the usual known methods. Those among them which are water-soluble or alkali-soluble may be added to the emulsions in the form of aqueous solutions, optionally with the addition of water-miscible organic solvents such as ethanol, acetone or dimethylformamide. Those among the non-diffusible colour couplers and colour producing compounds which are insoluble in water or alkalies may be emulsified in known manner, for example by adding a solution of these compounds in a low boiling organic solvent straight to the silver halide emulsion or by first mixing it with an aqueous gelatine solution and then removing the organic solvent in the usual manner. The resulting emulsion of the compound in gelatine is then mixed with the silver halide emulsion. If desired, so-called coupler solvents or oil formers may also be added to assist emulsification of such hydrophobic compounds. These coupler solvents or oil formers are generally higher boiling organic compounds in which the non-diffusible colour couplers and development inhibitor releasing compounds which are required to be emulsified in the silver halide emulsions become occluded in the form of oily droplets. Information on this subject may be found, for example, in U.S. Pat. Nos. 2,322,027; 2,533,514; 3,689,271; 3,764,336 and 3,765,897. The usual silver halide emulsions are suitable for the present invention. The silver halide contained in them may consist of silver chloride, silver bromide, silver iodide or a mixture thereof.

The binder used for the photographic layers is preferably gelatine but this may be partly or completely replaced by other neutral or synthetic binders. Suitable natural binders include, for example, alginic acid and its derivatives such as its salts, esters or amides; cellulose derivatives such as carboxymethylcellulose; alkylcelluloses such as hydroxyethylcellulose, and starch or its derivatives such as its ethers or esters, or carrageenates. Suitable synthetic binders include, for example, polyvinyl alcohol, partially saponified polyvinyl acetate and polyvinyl pyrrolidone.

The emulsions may also be chemically sensitized, for example by the addition of sulphur compounds such as allylisothiocyanate, allylthiourea or sodium thiosulphate at the chemical ripening stage. Reducing agents may also be used as chemical sensitizers, e.g. the tin compounds described in Belgian Pat. Nos. 493,464 or 568,687, polyamines such as diethylene triamine, or aminomethanesulphinic acid derivatives, e.g. according to Belgian Pat. No. 547,323.

Noble metals such as gold, platinum, palladium, iridium, ruthenium or rhodium and compounds of these metals are also suitable chemical sensitizers. This method of chemical sensitization has been described in the article by R. Koslowsky, Z. Wiss. Phot. 46, 65–72 (1951).

The emulsions may also be sensitized with polyalkylene oxide derivatives, e.g. with a polyethylene oxide having a molecular weight of between 1000 and 20,000, or with condensation products of alkylene oxide and aliphatic carboxylic acids, aliphatic amines, aliphatic diamines or amides. The condensation products have a molecular weight of at least 700, preferably more than 1000. These sensitizers may, of course, be combined in order to achieve special effects, for example as described in Belgian Pat. No. 537,278 and British patent specification No. 727,982.

The emulsions may also be spectrally sensitized, e.g. with the usual monomethine or polymethine dyes such as acid or basic cyanines, hemicyanines, streptocyanines, merocyanines, oxanoles, hemioxanoles, styrene dyes or others, including also trinuclear or multinuclear methine dyes, for example rhodacyanines or neocyanines. Sensitizers of this kind have been described, for example, in the work by F. M. Hamer entitled "The Cyanine Dyes and Related Compounds" (1964), Interscience Publishers John Wiley and Sons. The emulsions may contain the usual stabilizers, e.g. salts or homopolar compounds of mercury containing aromatic or heterocyclic rings, such as mercapto triazoles, simple mercury salts, sulphonium mercury double salts and other mercury compounds. Azaindenes are also suitable stabilizers, particularly the tetra- or penta-azaindenes and especially those which are substituted with hydroxyl or amino groups. Compounds of this kind have been described in the article by Birr, Z. Wiss. Phot. 47, 2 to 58 (1952). Other suitable stabilizers include heterocyclic mercapto compounds, e.g. phenylmercaptotetrazole, quaternary benzothiazole derivatives and benzotriazole.

The emulsions may be hardened in the usual manner, for example with formaldehyde or halogenated aldehydes containing a carboxyl group, such as mucobromic acid, diketones, methanesulphonic acid esters and dialdehydes.

The photographic layers may also be hardened with epoxy hardeners, heterocyclic ethyleneimine hardeners or acryloyl hardeners. Examples of such hardeners have been described, for example, in German Offenlegungsschrift No. 2,263,602 and in British Pat. No. 1,266,655. The layers may also be hardened by the process according to German Offenlegungsschrift No. 2,218,009, to produce colour photographic materials which are suitable for high temperature processing.

The photographic layers or colour photographic multilayered materials may also be hardened with hardeners of the diazine, triazine or 1,2-dihydroquinoline series as described in British patent specifications Nos. 1,193,290; 1,251,091; 1,306,544 and 1,266,655, French Pat. No. 7,102,716 or British patent specification No.

1,452,669. Examples of such hardeners include diazine derivatives containing alkylsulphonyl or arylsulphonyl groups, derivatives of hydrogenated diazines or triazines such as 1,3,5-hexahydrotriazine, fluorosubstituted diazine derivatives such as fluoropyrimidines, and esters of 2-substituted 1,2-dihydroquinoline- or of 1,2-dihydroisoquinoline-N-carboxylic acids. Vinylsulphonic acid hardeners, carbodiimide hardeners and carbamoyl hardeners are also suitable, e.g. those described in German Offenlegungsschriften Nos. 2,263,602; 2,225,230 and 1,808,685, French Pat. No. 1,491,807, German Pat. No. 872,153 and DDR Pat. No. 7218. Other suitable hardeners have been described, for example, in British Pat. No. 1,268,550.

The usual substrates may be used, for example, foils of cellulose nitrate, cellulose acetate such as cellulose triacetate, polystyrene, polyesters such as polyethylene terephthalate, polyolefines such as polyethylene or polypropylene, baryta paper supports or polyolefine-laminated paper supports, such as polyethylene laminated supports, and glass.

According to the invention, a conventional colour photographic colour reversal material in film or paper form, is exposed imagewise and subjected to a black and white first development and a short stop bath and then may be washed with water. It is then treated with a neutral or acid solution of the potential fogging agent to be used according to the invention. If metal salts are used as the potential fogging agents, the metal ion of higher valency produced in a fogging rection is preferably converted into a complex by means of a complexing agent. When the photographic layers have been uniformly soaked with the solution of potential fogging agent containing the preliminary bath, the photographic material is introduced into an alkaline bath in which fogging is produced by reduction of the silver ions to metallic silver nuclei. After fogging in this alkaline bath, the photographic material is introduced into a second colour developer, optionally after being first rinsed with water. According to another, preferred embodiment of this invention, the second colour developer, which is in any case alkaline, is used as the fogging bath.

The fogging bath may be adjusted to an alkaline pH by addition of the usual reagents such as hydroxides of the alkali metal or alkaline earth metals or of ammonium, or by addition of carbonates and phosphates or borates of the alkali metals, of ammonium or substituted ammonium. The fogging baths preferably also contain complexing agents and should always contain them if none were used in the preliminary bath. Apart from the sequestering agents which are usually present in any case as protection against calcium containing sludges, the second colour development bath may contain other complexing agents which may or may not be the same as those used in the preliminary baths or the fogging bath. According to a preferred embodiment of this invention, the second colour development bath contains complexing agents which are also capable of binding traces of cations which would otherwise be liable to catalyse the decomposition of some colour developer constituents.

The advance achieved by the process according to the invention compared with fogging processes previously employed lies mainly in the high stability of the potential fogging agents under the conditions of the preliminary bath in which the latter are contained. Another important advantage of the process according to the invention is that, in this process, it is much less important than in the previous processes to observe an upper concentration limit of the potential fogging agent in the preliminary baths since fogging does not take place in the preliminary bath itself but in the subsequent alkaline bath or even later, in the colour development bath. In addition, the iron$^{++}$ ions which are preferably used as fogging agents are ecologically virtually harmless, and iron compounds are comparatively inexpensive.

EXAMPLE 1 (COMPARISON EXPERIMENT )

A commercial colour photographic multilayered reversal material having a red-sensitive, a green-sensitive and a blue-sensitive silver halide emulsion layer and containing colour couplers for each of the partial images in the light-sensitive layers is exposed imagewise in the usual manner. The exposed colour photographic material is then subjected to a first development in a developer of the following composition:

Development Bath 1

| | |
|---|---|
| p-Methylaminophenol | 3 g/l |
| Hydroquinone | 6 g/l |
| Sodium carbonate | 40 g/l |
| Sodium sulphite | 40 g/l |
| Potassium bromide | 2.2 g/l |
| Potassium iodide | 0.010 g/l |
| Potassium thiocyanate | 2.2 g/l |
| Ethylenediaminotetracetic acid | 2 g/l |

After a short stop bath, the photographic material is washed and then subjected to a diffuse overall second exposure. A second colour reversal development is then carried out in a bath of the following composition:

Developer 2

| | |
|---|---|
| Hydroxylamine sulphate | 1.2 g/l |
| N,N-diethyl-p-phenylenediamino-sulphate | 5 g/l |
| Potassium carbonate | 70 g/l |
| Potassium bromide | 1 g/l |
| Sodium sulphite | 6 g/l |
| Ethylene diaminotetracetic acid | 2 g/l |
| 1-Hydroxy-ethylidene-1,1-diphosphonic acid | 2 g/l |

The photographic material is then treated in a short stop bath, washed, and then bleached and fixed or bleach-fixed and washed in known manner.

EXAMPLE 2

The colour photographic reversal material according to Example 1 is exposed imagewise and processed in the same way as described in Example 1 except that the second exposure is replaced by 2 minutes' treatment in an aqueous bath having the following compositions:

Preliminary Bath A

| | |
|---|---|
| Iron sulphate ($FeSO_4 . 7H_2O$) | 10 g/l |
| 1-Hydroxy-ethylidene-1,2-diphosphonic acid | 20 g/l |

The maximum colour density values obtained are at least 90% of the values obtained when a second exposure as indicated in Example 1 is carried out.

EXAMPLE 3

The colour photographic reversal material of Example 2 is processed in the same way as described in Example 2 except that a preliminary bath of the following composition is used:

Preliminary Bath B

| | |
|---|---|
| Iron sulphate ($FeSO_4 . 7 H_2O$) | 10 g/l |
| Potassium fluoride | 15 g/l |

The maximum colour density values obtained when using preliminary bath B are 95% of the values obtained in Example 1. The graduation is steeper; fog is not greater than in Example 2 or Example 1.

EXAMPLE 4

The colour photographic reversal material of Example 1 is exposed imagewise in the usual manner and subjected to a first development with developer $E_1$ described in Example 1. After a short stop bath and washing, the photographic material is kept for 1 to 2 minutes in a preliminary bath having the following composition:

Preliminary Bath C

| | |
|---|---|
| Iron Sulphate ($FeSO_4 . 7 H_2O$) | 10 g/l |
| Citric acid | 10 g/l |

Preliminary Bath D

| | |
|---|---|
| Cerium (III)-chloride ($CeCl_3 . 7 H_2O$) | 5 g/l |
| Disodium salt of ethylene diaminotetracetic acid | 15 g/l |

The bath is adjusted to pH 4 by addition of the necessary quantity of NaOH.

Preliminary Bath E

| | |
|---|---|
| Iron sulphate ($FeSO_4 . 7 H_2O$) | 10 g/l |
| Disodium salt of ethylene diaminotetracetic acid | 15 g/l |

The bath is adjusted to pH 4 by addition of the necessary quantity of NaOH.

Preliminary Bath F

| | |
|---|---|
| Manganese chloride ($MnCl_2 . 4H_2O$) | 10 g/l |

Preliminary Bath G

| | |
|---|---|
| Iron sulphate ($FeSO_4 . 7H_2O$) | 10 g/l |
| $H_2SO_4$ conc. | 1 ml |

After treatment of the photographic material in one of these preliminary baths, it is introduced into 5% sodium hydroxide solution for 1 to 2 minutes, washed in water for 1 to 5 minutes and then introduced into a second colour reversal development bath and treated as indicated in Example 1.

The full maximum colour density obtained by the standard second exposure (Example 1) is also achieved in all these cases, with only insignificant differences.

EXAMPLE 5

The colour photographic reversal material of Example 1 is processed in the same way as described in Example 4 except that the photographic material is introduced into an aqueous preliminary bath having the following compositions:

Preliminary Bath H

| | |
|---|---|
| Hydrazinium sulphate | 10 g/l |

Preliminary Bath I

| | |
|---|---|
| Formamidine-C-sulphinic acid (thiourea dioxide) | 1.5 g/l |

When preliminary bath H is used, the maximum densities of yellow and magenta are slightly lower than those obtained by processing with a second exposure but the maximum densities for magenta are increased. When preliminary bath I is used, the same maximum densities are obtained as in the cae of the second exposure.

I claim:

1. In a photographic reversal process for the production of positive photographic images comprising the steps of first imagewise exposure of a light sensitive material comprising at least one silver halide emulsion layer and then black and white development of said exposed material in a first development, subsequent to said black and white development treatment of the exposed and developed material in a preliminary bath with an agent selected from the group consisting of metal ions of metals of the transition elements, hydrazine salts or salts of hydrazine derivatives, hydroxylamine salts or salts of hydroxylamine derivatives, iminoaminomethane sulphinic acid compounds and thiourea dioxide, and then further treating the material in an alkaline bath, and subsequently color development of the exposed and developed and treated material by reaction of the color couplers with oxidized color developer, so as to provide the exposed and developed and treated material with chemical fogging after black and white development and before color development.

2. Process according to claim 1, characterised in that the potential fogging agents used are compounds of titanium, manganese, iron, cobalt or cerium.

3. Process according to claim 1, characterised in that the potential fogging agents used are iron compounds.

4. Process according to claim 1, characterised in that the potential fogging agents used are titanium compounds.

5. Process according to claim 1, characterised in that the metal ions are present as complex compounds before and after fogging.

6. Process according to claim 5, characterised in that the metal ions are present as complex compounds after fogging.

7. Process according to claim 5, characterised in that carboxylic acids, phosphonic acids or phosphono carboxylic acids are used as complexing agents for the metal ions.

8. Process according to claim 7, characterised in that the complexing agents for the metal ions are hydroxycarboxylic acids, polycarboxylic acids, hydroxypolycarboxylic acids, polyhydroxypolycarboxylic acids, aminoalkylcarboxylic acids, hydroxyalkylidenephosphonic acids aminoalkyl phosphonic acids.

9. Process according to claim 7, characterised in that the complexing agents used are oxalic acid, citric acid, ethylene diaminotetracetic acid, 1-hydroxyethylidene-1,1-diphosphonic acid, tartaric acid or nitrilotrimethylene triphosphonic acid.

* * * * *